United States Patent [19]

Chern

[11] Patent Number: 4,873,898

[45] Date of Patent: Oct. 17, 1989

[54] RATCHETLESS REVERSIBLE WRENCH

[76] Inventor: Shyh Chern, No. 111, Lane 41, Sec. 1, Hsingjen Rd., Tali Hsiang, Taichung Hsien, Taiwan

[21] Appl. No.: 299,777

[22] Filed: Jan. 23, 1989

[51] Int. Cl.[4] ..... B25B 13/46

[52] U.S. Cl. ..... 81/59.1

[58] Field of Search ..... 81/59.1, 60, 63.1; 192/43, 44, 45

[56] References Cited

U.S. PATENT DOCUMENTS 4,429,598 2/1984 Tucker ..... 81/59.1

4,603,606 8/1986 Header ..... 81/59.1

*Primary Examiner*—D. S. Meislin

*Attorney, Agent, or Firm*—Bernard R. Gans

[57] ABSTRACT

A reversible wrench including a handle portion and a head portion. The head portion has a post compartment with evenly spaced receptacles around it. The post compartment receives a post plate with engagement posts on it. A driving head piece fits at the lower end of the head portion. The driving head includes an integral driving head, slip plate and cylindrical block. The cylindrical block extends upward through the post compartment and is received at the other end by a tab (cover) and is threadably secured with the tab. An arm with a protuberance on it urges the post plate and hence the engagement posts so as to bias the direction which the wrench can be turned.

1 Claim, 5 Drawing Sheets

RATCHETLESS REVERSIBLE WRENCH

BACKGROUND OF THE INVENTION

This invention relates to wrenches, and in particular relates to interchangeable reversible wrenches. In the past, most, if not all, reversible wrenches were ratchet wrenches. These ratchet wrenches are still widely used and very practical as they provide for interchangeability. However, there are still a few shortcomings with conventional ratchet wrenches. The first is that ratchet wrenches are inherently noisy due to the ratchet therein. The second is that ratchet wrenches do not necessarily provide for smooth engagement when driving a nut.

It is the purpose of this present invention, therefore, to mitigate and/or obviate the abovementioned drawbacks in the manner set forth in the detailed description of the preferred embodiment.

SUMMARY OF THE INVENTION

A primary objective of this invention is to provide a reversible interchangeable wrench which is ratchetless.

Another objective of this invention is to provide a reversible ratchetless wrench which provides guaranteed smooth engagement (which eliminates jerkiness) when driving nuts.

A further objective of this invention is to provide a reversible ratchetless wrench which is noiseless.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
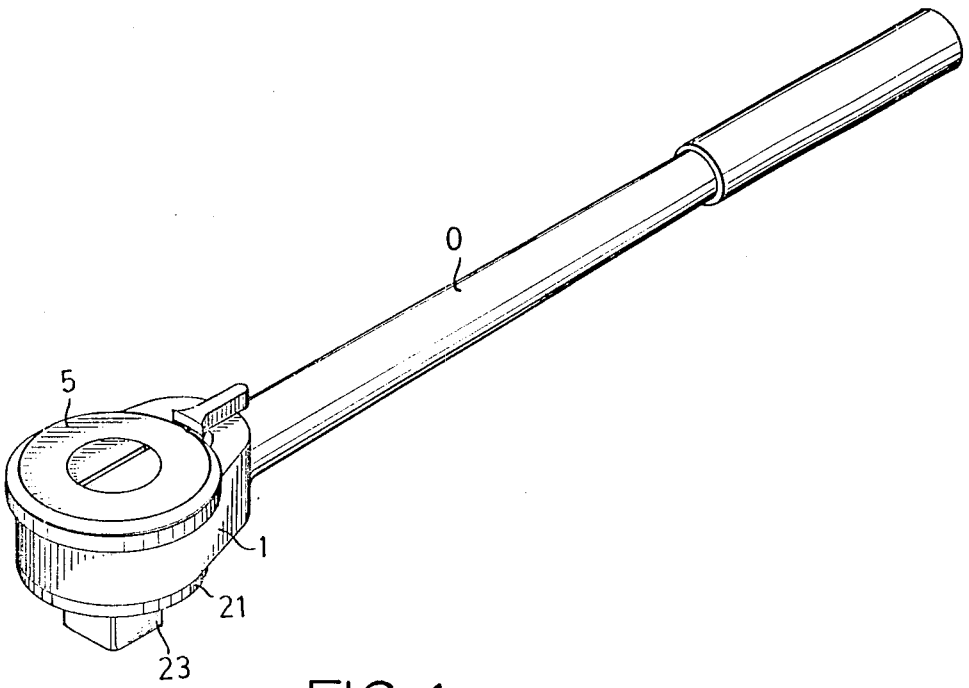
FIG. 1 is a perspective view of a ratchetless reversible wrench in accordance with the present invention.

Referring to FIG. 1, it can be seen that the ratchetless reversible wrench of the present invention has a conventional handle portion 0 with a head portion 1 at one end thereof.

Figure 2:
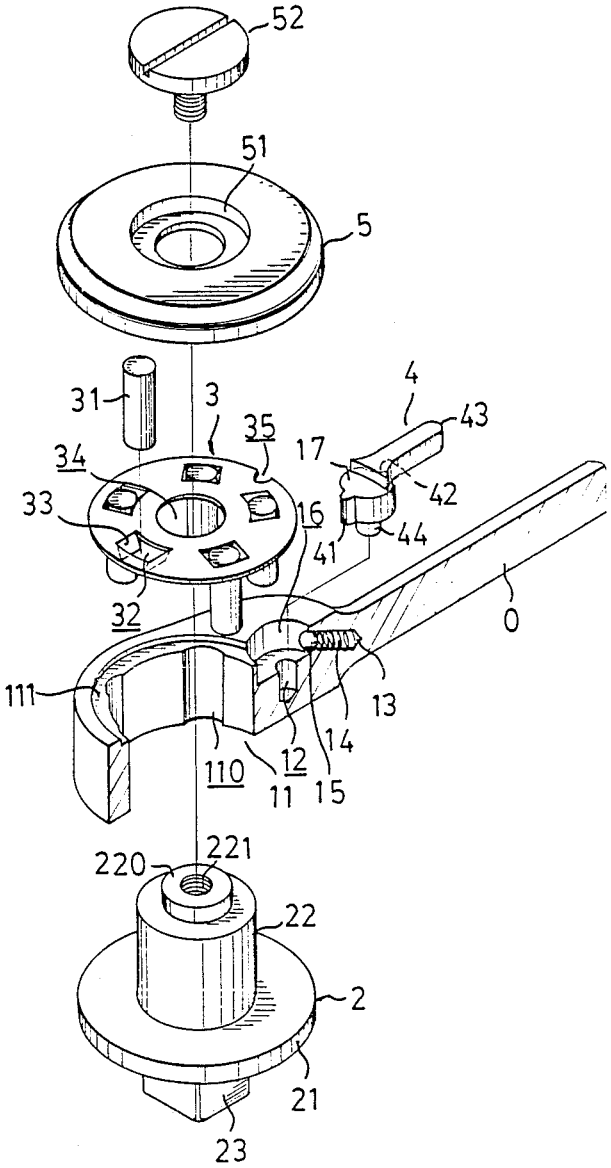
FIG. 2 is an exploded view of the wrench of FIG. 1.
Figure 4:
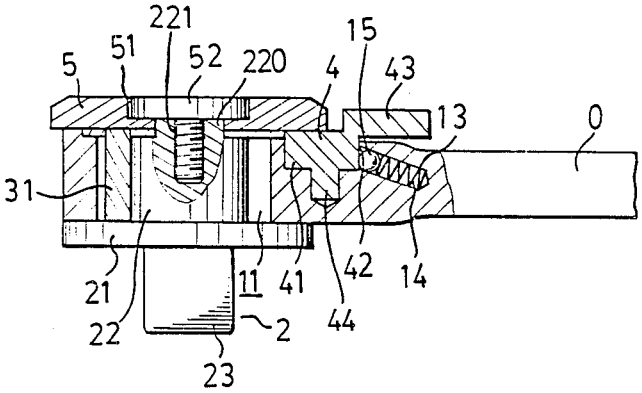
FIG. 4 is a side cutaway view of the head portion of the wrench of FIG. 1.
Figure 3:
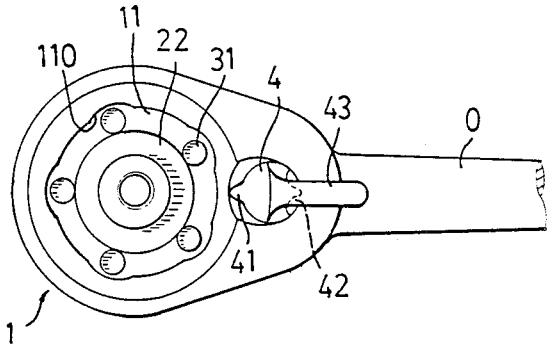
FIG. 3 is a top view of the head portion of the ratchetless wrench of FIG. 1 with the tab and post plate not shown therein.

Further referring to FIG. 2, it can be seen that the head portion 1 comprises the combination of a substantially circular post compartment 11, a driving head piece 2, a circular post plate 3, a circular tab 5, first, second, and third bores (16, 12, and 13, respectively) on the top rear portion thereof, and a lever switch 4.

The post compartment 11 has a plurality of concave receptacles 110 evenly spaced therearound and an annular recess 111 at the upper end thereof.

The driving head piece 2 includes an annular slip plate 21, a driving head block 23, and a cylindrical block 22. The upper surface of the slip plate 21 slidably contacts a lower surface of the post compartment 11. The cylindrical block 22 has a circular protrusion 220 at the upper end thereof.

Figure 7:
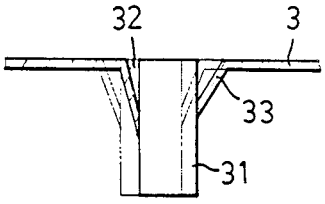
FIG. 7 is a side cutaway view of a portion of the post plate of FIG. 5 showing how the retainer plates thereof retain the engagement post.

The circular post plate 3, including a plurality of gaps 32 evenly spaced therearound, fits into the circular recess 111 at the upper end of the post compartment 11. Each gap 32 has a respective slanted retainer plate 33 set at each end thereof to retain an engagement post 31 therein. A cutaway view of a typical set of retainer plates 33 and a corresponding engagement post 31 can be seen in FIG. 7. A center hole 34 is set on the post plate 3 for tightly engaging with the circular protrusion 220.

The circular tab 5 covers the post plate 3. The tab 5 has a counterbore 51 thereon with a hole in the center thereof for receiving a screw 52. The screw 52 is threadably securable with threads 221 of the cylindrical block 22.

The first bore 16 is positioned proximate to the rear end of the post compartment 11. The first bore 16 has a central second bore 12 as the lower end thereof and a third bore 13 which extends angularly towards the handle portion 0.

Referring to FIG. 3 to 6, the lever switch 4 having an arm 43, a circular portion 17, and a pivot post 44 thereon can be seen. The pivot post 44, and hence the lever switch 4, is rotatable in the second bore 12. The lever switch 4 has a vertically extending protuberance 41 on a front end thereof which is engageable with a notch 35 on the post plate 3. The third bore 13 has a spring 14 therein for springloading a steel ball 15 against the rear portion of the lever switch 4, which has concavities 42 thereat for securing the lever switch 4 in either a clockwise or counterclockwise orientation.

Figure 6:
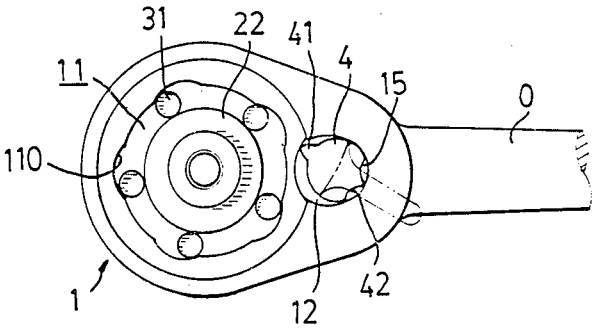
FIG. 6 is a view similar to FIG. 5, but with the post plate not shown.
Figure 5:
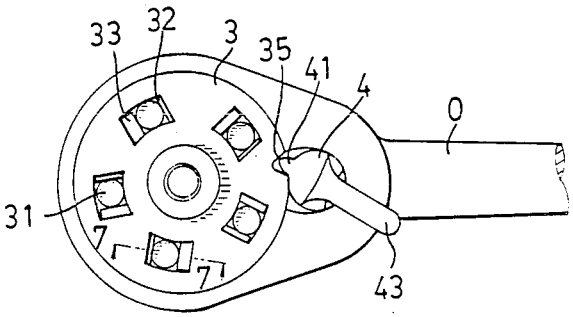
FIG. 5 is a view similar to FIG. 3, but with the post plate shown and with the arm in clockwise engaged position.

When the user rotates the arm 43 about the pivot post 44, the protuberance 41 engages with a notch 35 on the post plate 3 to urge the post plate 3 and engagement posts 31 to rotate and wedge between the wall of the post compartment 11 and the cylindrical block 22 so as to frictionally urge the cylindrical block 22 and the driving head block 23 to rotate. When the user moves the arm 43 to either a clockwise or counterclockwise orientation, the protuberance 41 urges the post plate 3 and hence the engagement posts 31 so as to bias the direction which the driving head block 23 can be turned. This condition is most easily understood by viewing FIG. 5 and 6. In FIG. 5 and 6, the lever arm 43 has been turned by the user to a clockwise orientation. This urges the post plate 3 to move to a counterclockwise orientation. Since the engagement posts 31 are wedged between the wall of the post compartment 11 and the cylindrical block 22, any clockwise movement of the handle 0 frictionally urges the cylindrical block 22 and hence the driving head block 23 clockwise. Similarly, if the lever arm 43 is set to a counterclockwise position by the user, then the driving head block 23 can only be frictionally urged or turned in a counterclockwise direction.

Figure 8:
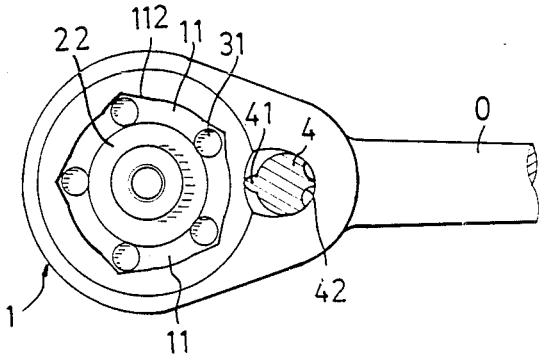
FIG. 8 is an alternate embodiment similar to FIG. 3, wherein the receptacles are notched rather than smooth concave shape, and the top portion of the lever switch 4 is cutaway for clarity.

FIG. 8 shows an alternate embodiment of the present invention wherein notched receptacles 112 are used rather than smooth concave receptacles. In this figure, the top portion of the lever switch 4 is cutaway so that the concavities 42 for engagement of the spring-loaded steel ball 15 (FIG. 4) can be clearly seen.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A ratchetless reversible wrench with a handle portion (0) and a head portion (1) at one end thereof, said head portion (1) comprising the combination of:

(a) a substantially circular post compartment (11); said post compartment (11) having a plurality of concave receptacles (110) evenly spaced therearound; said post compartment (11) having an annular recess (111) at an upper end thereof;

(b) a driving head piece (2) including an annular slip plate (21), a driving head block (23), and a cylindrical block (22); an upper surface of said slip plate (21) slidably contacting a lower surface of said post compartment (11); said cylindrical block (22) having a circular protrusion (220) at an upper end thereof;

(c) a circular post plate (3) including a plurality of gaps (32) evenly spaced therearound; each gap (32) having a slanted retainer plate (33) respectively set at each end thereof to retain a respective engagement post (31) in each gap (32) therein; a center hole (34) being set on said post plate (3) for tightly engaging with said circular protrusion (220);

(d) a circular tab (5) for covering said post plate (3); said tab (5) having a counterbore (51) thereon with a hole in the center thereof for receiving a screw (52); said screw (52) being threadably securable with threads (221) of said cylindrical block (22);

(e) a first bore (16) which is positioned proximate to a rear end of said post compartment (11); said first bore (16) having a central second bore (12) and a third bore (13) which extends angularly towards said handle portion (0); and (f) a lever switch (4); said lever switch (4) having an arm (43), a circular portion (17), and a pivot post (44) thereon; said lever switch (4) being rotatable in said second bore (12) and having a vertically extending protuberance (41) on a front end thereof which is engageable with a notch (35) on said post plate (3);

said arm (43) being rotatable about said pivot post (44) so that said protuberance (41) engages with a notch (35) on said post plate (3) to urge said post plate (3) and engagement posts (31) to rotate and wedge between a wall of said post compartment (11) and said cylindrical block (22) so as to frictionally urge said cylindrical block (22) and a driving head block (23) to rotate.

* * * * *

UNITED STATES PATENT AND TRADEMARK OFFICE

CERTIFICATE OF CORRECTION

PATENT NO. : 4,873,898

DATED : October 17, 1989

INVENTOR(S) : Chern

It is certified that error appears in the above-identified patent and that said Letters Patent is hereby corrected as shown below:

Title page, Item [76] inventor:

"Shyh Chern" should read --Shyh Y. Chern--.

Signed and Sealed this

Tenth Day of December, 1991

*Attest:*

HARRY F. MANBECK, JR.

*Attesting Officer*

*Commissioner of Patents and Trademarks*